US006752286B2

(12) United States Patent
Liu

(10) Patent No.: US 6,752,286 B2
(45) Date of Patent: Jun. 22, 2004

(54) ASSEMBLED CLOTHES HAMPER

(76) Inventor: Lin-Ho Liu, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/024,233

(22) Filed: Dec. 21, 2001

(65) Prior Publication Data

US 2003/0116565 A1 Jun. 26, 2003

(51) Int. Cl.[7] ..... B65B 67/04
(52) U.S. Cl. ..... 220/9.4; 248/97; 248/99
(58) Field of Search ..... 220/9.4, 9.1; 248/97, 248/99, 95

(56) References Cited

U.S. PATENT DOCUMENTS 269,625 A * 12/1882 Blake ..... 248/98
711,410 A * 10/1902 Means ..... 220/9.1
967,368 A * 8/1910 Grigsby ..... 4/285
4,267,997 A * 5/1981 Meier ..... 220/491
4,281,813 A * 8/1981 Garrity ..... 248/97
4,575,895 A * 3/1986 Spellman ..... 15/327.1
4,705,246 A * 11/1987 Wolf ..... 248/97
5,287,985 A * 2/1994 Hatayama ..... 220/9.4
6,520,457 B1 * 2/2003 Yardley et al. ..... 248/99

* cited by examiner

*Primary Examiner*—Joseph Man-Fu Moy
(74) *Attorney, Agent, or Firm*—Troxell Law Office PLLC

(57) ABSTRACT

The present invention of an assembled clothes hamper mainly has an entire clothes hamper designed as a hamper body in the shape of a vertical barrel to be assembled by a bottom seat, a top ring as well as a plurality of partition rings; all the said members are fitted with, interlocked and firmly clamped by a pair of vertical side frames to form a clothes hamper to be assembled by a customer and advantageous for detaching every member into a simplest form to facilitate the stacking package, increase the shipment, the storage and the selling.

9 Claims, 4 Drawing Sheets

ASSEMBLED CLOTHES HAMPER

BACKGROUND OF THE INVENTION

1) Field of the Invention

The present invention relating to an assembled clothes hamper aims to provide a clothes hamper structure to be assembled by a customer; every member of the entire clothes hamper can be detached into a simplest form to facilitate the stacking package, increase the shipment, the storage and the selling.

2) Description of the Prior Art

Accordingly, at home or in a laundry factory, clothes hampers have been used for temporarily storing or even for separating soiled clothing by different material fabrics; therefore a regular clothes hamper must have sufficient capacity for accommodating clothing without occupying oversized planar space; thereby most of the external structures of clothes hampers available on the market are designed in a form of a barrel for raising the height of the entire clothes hamper so as to increase the capacity thereof.

However, most of the present clothes hampers are molded through plastic injection, the external forms of manufactured clothes hampers are fixed and that increases a lot of troublesomeness during the process of shipping, storing and selling due to the huge external volume; more particularly, the factor of occupying too much shipment space might reduce the customer's purchasing desire.

SUMMARY OF THE INVENTION

Therefore, the primary objective of the present invention is to have an entire clothes hamper designed as a vertical barrel body to be assembled by a bottom seat, a top ring as well as a plurality of partition rings; all the said members are fitted with, interlocked and firmly clamped by a pair of vertical side frames to form a clothes hamper to be assembled by a customer and every member thereof can be detached into a simplest form to facilitate the stacking package, increase the shipment, the storage and the selling.

Another objective of the present invention of an assembled clothes hamper is to have wheels mounted on the bottom portion to increase the facility of moving and shipping the clothes hamper.

Yet another objective of the present invention of an assembled clothes hamper is to insert a removable sleeve bag into the hamper body of the clothes hamper for accommodating the objects; when the sleeve bag is full, it can be directly pulled from the clothes hamper so as to easily accomplish the packing of the objects.

For achieving the above objectives, the brief description of the drawings below is followed by the detailed description of the preferred embodiment.

DETAILED DESCRIPTION OF THE PREFERRED EMBODIMENTS

Figure 1:
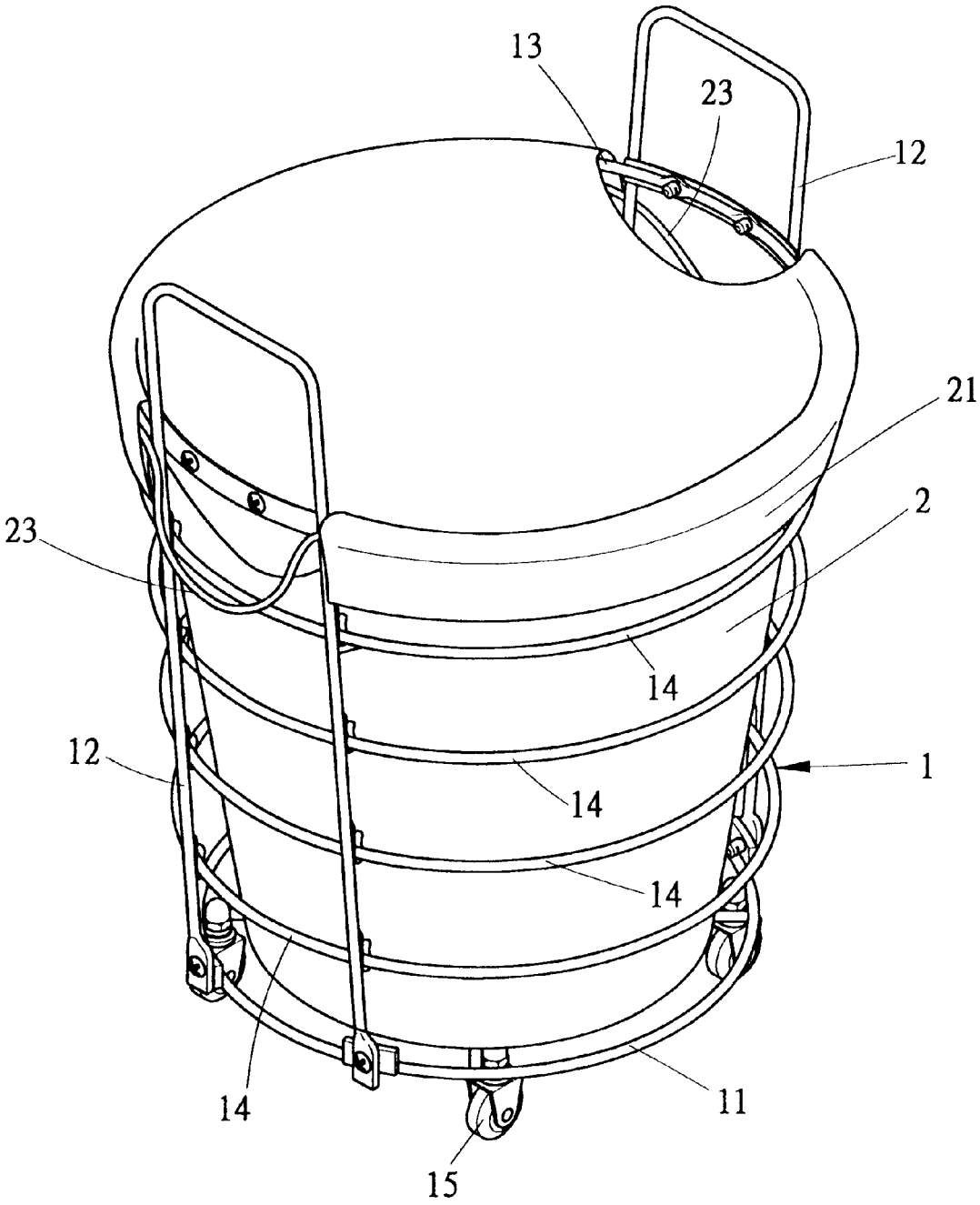
FIG. 1 is an external view drawing of one of the preferred exemplary embodiments of the entire clothes hamper in application of the present invention.

The present invention relates to an assembled clothes hamper comprising an entire clothes hamper (1) in a form of a circular barrel hamper structure, referring to FIG. 1, for directly facilitating the accommodation of clothing or other objects; or as shown in the Figure, a removable sleeve bag (2) is fitly sleeved in the hamper body of the clothes hamper (1) for placing the objects; when the sleeve bag (2) is full, it can be directly pulled from the clothes hamper (1) to easily accomplish the packing of the objects.

Figure 2:
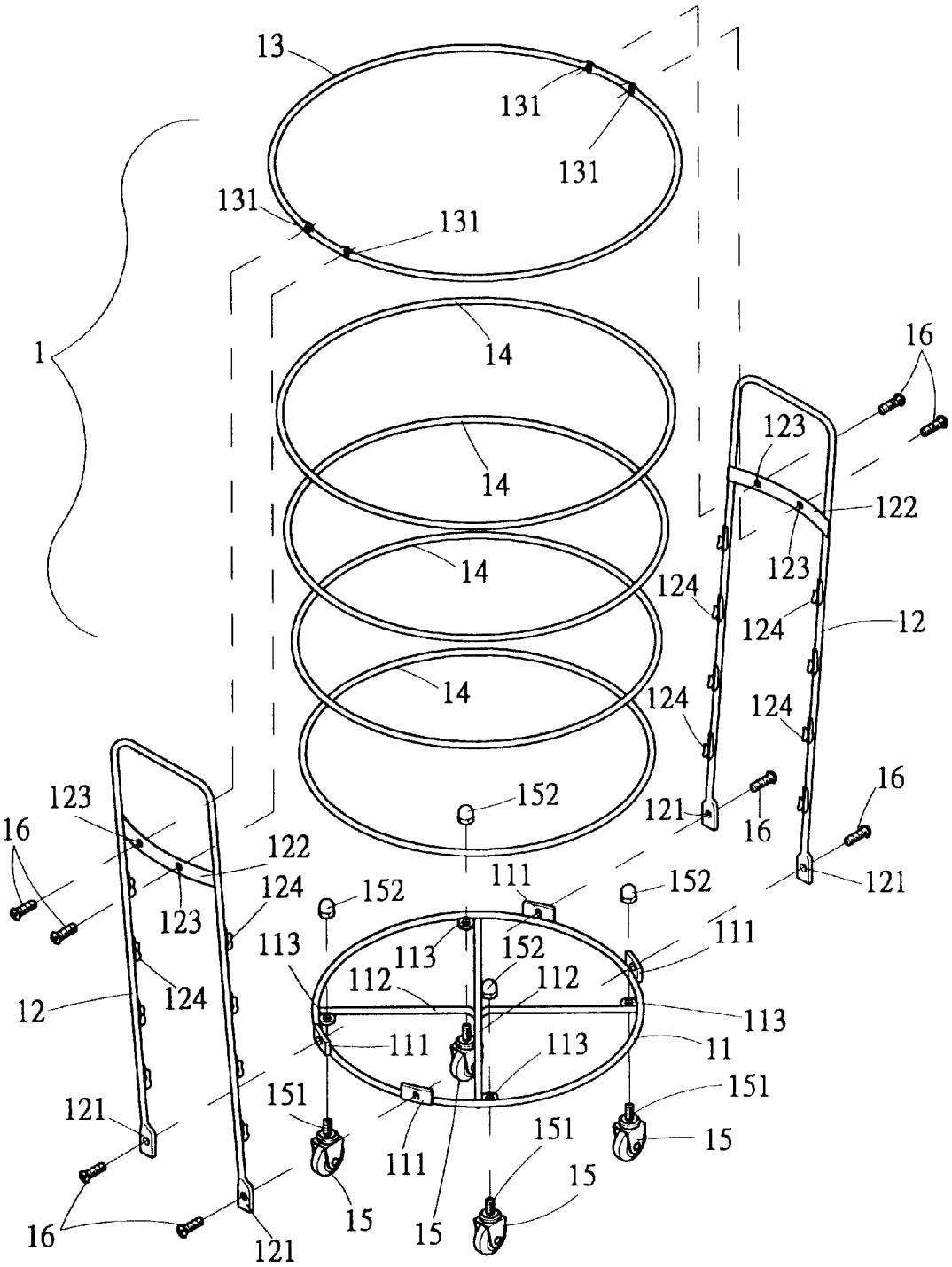
FIG. 2 is an exploded drawing of the clothes hamper structure of the present invention.
Figure 3:
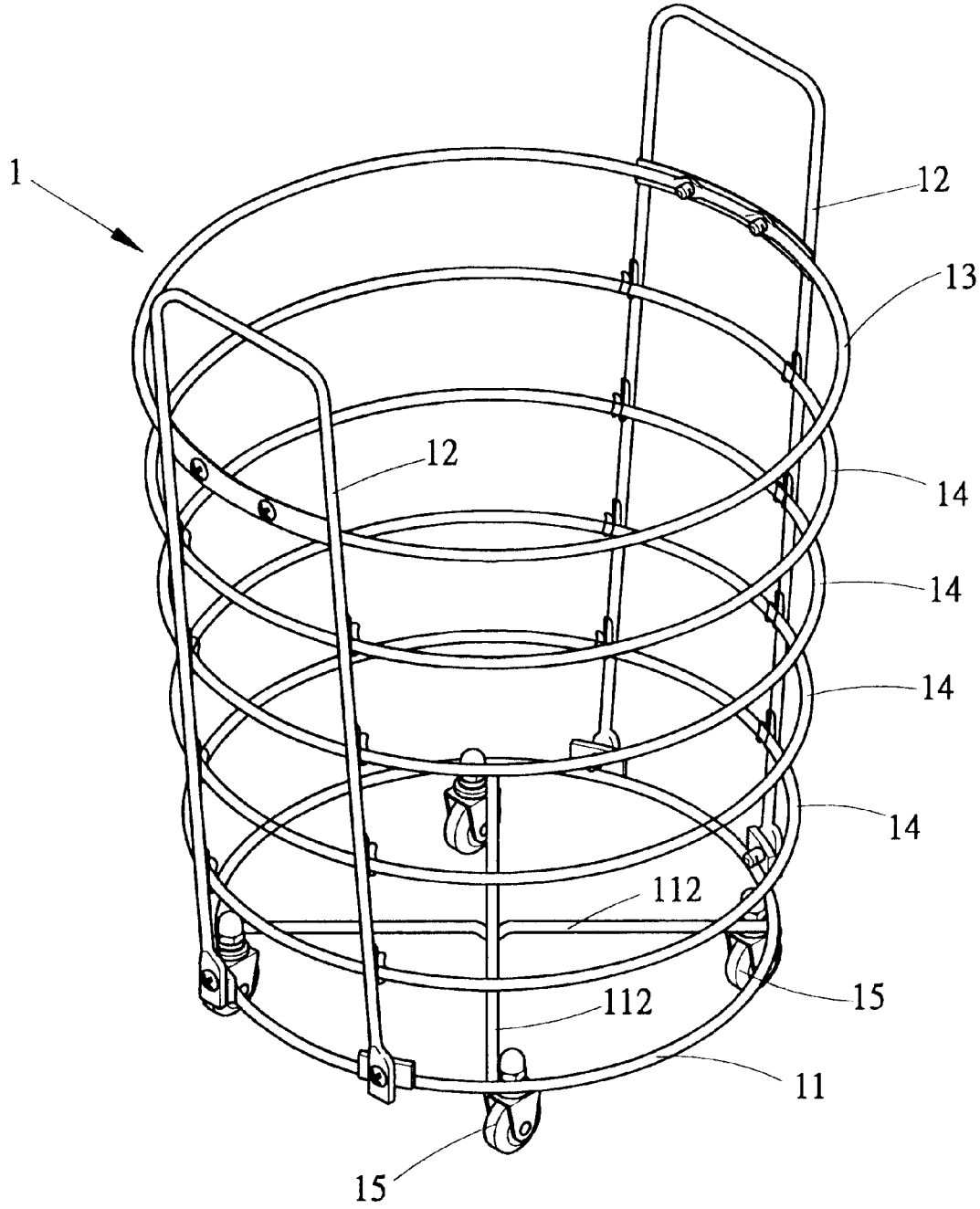
FIG. 3 is an external view drawing of the assembled clothes hamper structure of the present invention.

Referring to FIGS. 2 and 3, the major point of the present invention is to design the entire clothes hamper (1) as a hamper body in the shape of a vertical barrel to be assembled by a bottom seat (11), a top ring (13) as well as a plurality of partition rings (14); all the said members are fitted with, interlocked and firmly clamped by a pair of vertical side frames (12) to form a clothes hamper (1) can be assembled by a customer; wherein the bottom seat (11) is a bottom disk structure in the shape of an annular ring and the side frame (12) is an n-shaped rod frame structure; the peripheral rim of the bottom seat (11) and the bottom rim of the side frames (12) are respectively disposed with lock-joint ears (111, 121) with screw holes for firmly locking the bottom seat (11) to the bottom end of the side frames (12); a connecting plate (122) is disposed at the top end of the side frame (12) adjacent to the bent portion for strengthening the rod structure of the side frame (12) and firmly locking the connection with the top ring (13); the peripheral rim of the top ring (13) is disposed to directly push against the connection plate (122) of the side frame (12); the joint area between the top ring (13) and the connection plate (122) are disposed respectively with screw holes (131, 123) to be fixedly locked by screw nails (16).

As to the midsection area fitly disposed between the bottom seat (11) and the top ring (13) of the side frame, it is mounted with retaining hooks (124) spaced in proper height; every partition ring (14) can be firmly clamped to the retaining hook (124) through a simple inserting action, thereby to accomplish the assembly of the entire clothes hamper (1); the bent portion at the top end of the side frame (12) can be used as a lift handlebar structure for facilitating shipment of the clothes hamper (1); in addition, the structure of the bottom seat (11) can be reinforced by the disposition of cross rods (112); a plurality of wheel insert holes (113) are fitly disposed for inserting the screw rods (151) at the top portion of wheels (15) from the lower aspect of the bottom seat (11) into the wheel insert holes (113); then the screw nuts (152) are used to firmly lock and mount wheels (15) to the bottom portion of the entire clothes hamper (1) so as to increase the user's facility of moving and shipping the clothes hamper (1).

Figure 4:
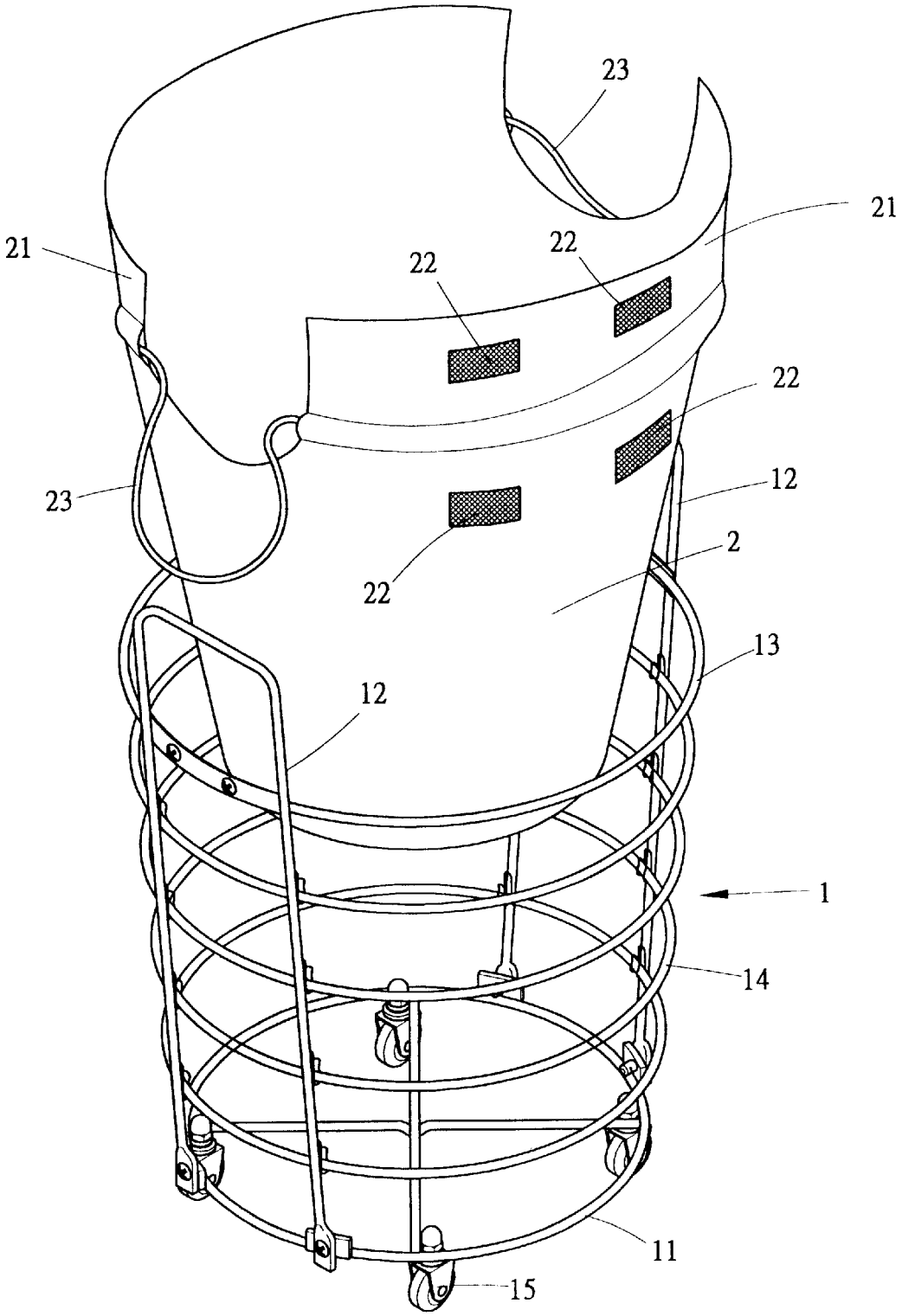
FIG. 4 is a schematic drawing of a sleeve bag structure of the present invention.

Furthermore, as shown in FIG. 4, the sleeve bag (2) used to fit with the clothes hamper (1) mainly has a folding section (21) extends upwards from the opening area of the bag body and reversely bends toward the bag body; a hook and loop fastener (22) is disposed at the corresponding position between the folding section (21) and the bag body; after being sleeved into the clothes hamper (1), the folding section (21) at the top portion of the sleeve bag (2) goes over the top ring (13), folds reversely toward the bag body and is snapped to affix by means of the hook and loop fastener (22); thereby, as shown in FIG. 1, the opening of the sleeve bag (2) is positioned at the top ring (13) area of the clothes hamper (1) and the function of the hook and loop fastener (22) enables repeatable detachment and usage; a lift string (23) can be fitly disposed at the opening area of the sleeve bag (2) to increase the facility of lifting; in a normal condition, the lift string (23) can be inserted onto the side frame (12) of the clothes hamper (1) to assist and reinforce the inserting function of the sleeve bag (2) and the clothes hamper (1).

The present invention of an assembled clothes hamper mainly comprises an entire clothes hamper designed in a vertical barrel shape to be assembled by a bottom seat, a top ring as well as a plurality of partition rings; all the said members are fitted with, interlocked and firmly clamped by a pair of vertical side frames to form a clothes hamper can be assembled to be a customer and advantageous for detaching every member into a simplest form to facilitate the stacking package, increase the shipment, the storage and the selling.

The present invention provides a preferred and feasible structure and it is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A clothes hamper comprising:

a) a top ring;

b) a bottom ring having a plurality of cross rods;

c) a plurality of partition rings located between the top and bottom rings; and d) two vertical side frames connected to opposite sides of the top ring, the bottom ring and the plurality of partition rings, each of the two vertical frames having a first end portion connected to the bottom ring and a second end portion connected to the to ping, the plurality of partition rings being spaced apart and removeably connected to each of the two vertical side frames between the top ring and the bottom ring.

2. The clothes hamper according to claim 1, further comprising a plurality of wheels connected to the bottom ring.

3. The clothes hamper according to claim 1, wherein the two vertical side frames each comprise an inverted U-shaped structure.

4. The clothes hamper according to claim 1, wherein the two vertical side frames each have a plurality of retaining hooks to connect the plurality of partition rings thereto.

5. The clothes hamper according to claim 1, further comprising two connecting plates, one connecting plate located on the second end portion of each of the two vertical side frames and connected to the top ring.

6. The clothes hamper according to claim 1, further comprising a sleeve bag with a closed end and an open end, the sleeve bag inserted into a hollow interior formed by the top ring, the plurality of partition rings and the bottom ring and having:

a) at least one folding section located on the open end and movable between an unfolded position and a folded position; and b) a plurality of fasteners for securing the at least one folding section in the folded position.

7. The clothes hamper according to claim 1, further comprising a lift string connected to the sleeve bag adjacent to the fold section.

8. The clothes hamper according to claim 1, wherein the plurality of fasteners comprise a plurality of hook and loop fasteners.

9. The clothes hamper according to claim 1, wherein the second end portions of the two vertical side frames extend above the top ring to form handles.

* * * * *